US010260495B2

(12) United States Patent
Sasaki et al.

(10) Patent No.: US 10,260,495 B2
(45) Date of Patent: Apr. 16, 2019

(54) BLOWER WITH A VIBRATING BODY HAVING A RESTRAINING PLATE LOCATED ON A PERIPHERY OF THE BODY

(71) Applicant: Murata Manufacturing Co., Ltd., Kyoto (JP)

(72) Inventors: Masahiro Sasaki, Kyoto (JP); Kiyoshi Kurihara, Kyoto (JP); Hiroaki Wada, Kyoto (JP); Nobuhira Tanaka, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 15/428,542

(22) Filed: Feb. 9, 2017

(65) Prior Publication Data

US 2017/0152845 A1 Jun. 1, 2017

Related U.S. Application Data

(63) Continuation of application No. PCT/JP2015/073176, filed on Aug. 19, 2015.

(30) Foreign Application Priority Data

Aug. 20, 2014 (JP) ..... 2014-167654

(51) Int. Cl.
*F04B 43/04* (2006.01)
*F04B 45/047* (2006.01)
(Continued)

(52) U.S. Cl.
CPC ..... *F04B 43/046* (2013.01); *F04B 43/028* (2013.01); *F04B 45/047* (2013.01);
(Continued)

(58) Field of Classification Search
CPC ..... F04F 7/00; F04B 45/047; F04B 43/0009; F04B 43/028; F04B 43/046; F04B 45/04; F04B 2203/0404
See application file for complete search history.

(56) References Cited

U.S. PATENT DOCUMENTS

2005/0069430 A1* 3/2005 Sugahara ..... B41J 2/14233 417/413.2
2006/0140782 A1* 6/2006 Weber ..... F04B 43/046 417/221
(Continued)

FOREIGN PATENT DOCUMENTS

JP 2009-074418 A 4/2009
JP 4795428 B2 10/2011
(Continued)

OTHER PUBLICATIONS

International Search Report issued in Application No. PCT/JP2015/073176 dated Nov. 17, 2015.
(Continued)

*Primary Examiner* — Bryan Lettman
*Assistant Examiner* — Timothy P Solak
(74) *Attorney, Agent, or Firm* — Pearne & Gordon LLP

(57) ABSTRACT

A piezoelectric blower includes a housing, a vibrating body, and a piezoelectric element. The vibrating body includes a vibration plate, a reinforcing plate, and a restraining plate. The vibrating body forms a columnar blower chamber with the housing while holding the blower chamber therebetween from a thickness direction of the vibration plate. The vibrating body includes an outer peripheral region in contact with an area from the outermost node of pressure vibration in the blower chamber, of nodes of the pressure vibration formed by the bending vibration of the vibrating body, to an outer periphery of the blower chamber, and a center region located in an inner side portion of the outer peripheral region. The
(Continued)

restraining plate that restrains the bending vibration of the outer peripheral region is provided in the outer peripheral region.

16 Claims, 10 Drawing Sheets

(51) Int. Cl.
*F04B 43/02* (2006.01)
*F04F 7/00* (2006.01)
*F04D 33/00* (2006.01)

(52) U.S. Cl.
CPC ..... *F04D 33/00* (2013.01); *F04F 7/00* (2013.01); *F04B 2203/0404* (2013.01)

(56) References Cited

U.S. PATENT DOCUMENTS

2006/0232167 A1* 10/2006 Jordan ..... F04B 43/0054 310/324
2009/0087323 A1 4/2009 Blakey
2009/0148318 A1 6/2009 Kamitani
2010/0074775 A1* 3/2010 Yamamoto ..... F04B 43/028 417/413.2
2011/0070109 A1* 3/2011 Kanai ..... F04B 45/047 417/410.2
2011/0081267 A1* 4/2011 McCrone ..... F04B 43/046 417/481
2011/0190670 A1* 8/2011 Jaeb ..... F04B 43/04 601/6
2013/0236338 A1 9/2013 Locke
2015/0150470 A1 6/2015 Sano

FOREIGN PATENT DOCUMENTS

JP 2012-528980 A 11/2012
JP 2013-245649 A 12/2013
JP 5928160 B2 6/2016
WO 2008/069264 A1 6/2008
WO 2010/139916 A1 12/2010

OTHER PUBLICATIONS

Written Opinion issued in Application No. PCT/JP2015/073176 dated Nov. 17, 2015.
Notice of Reasons for Rejection issued in Japanese Patent Application No. 2016-544222 dated Oct. 17, 2017.

* cited by examiner

--Comparative Example--

--Prior Art--

BLOWER WITH A VIBRATING BODY HAVING A RESTRAINING PLATE LOCATED ON A PERIPHERY OF THE BODY

This is a continuation of International Application No. PCT/JP2015/073176 filed on Aug. 19, 2015 which claims priority from Japanese Patent Application No. 2014-167654 filed on Aug. 20, 2014. The contents of these applications are incorporated herein by reference in their entireties.

BACKGROUND OF THE DISCLOSURE

Field of the Disclosure

The present disclosure relates to a blower that transports gas.

Description of the Related Art

Patent Document 1: Japanese Patent No. 4795428

There have hitherto been known various types of blowers that transport gas. For example, Patent Document 1 discloses a piezoelectrically driven pump.

FIG. 11 is a cross-sectional view of a pump 900 according to Patent Document 1.

This pump 900 includes a piezoelectric disk 920, a disc 912 to which the piezoelectric disk 920 is joined, and a main body 913 that defines a hollow 911 with the disc 912. The main body 913 has an inlet 915 through which gas flows in and an outlet 914 through which gas flows out. The main body 913 has a bottom plate 918.

The inlet 915 is provided in the bottom plate 918 between a center axis of the hollow 911 and an outer periphery of the hollow 911. The outlet 914 is provided in the bottom plate 918 at the center axis of the hollow 911. At the outlet 914, a valve 916 is provided to prevent gas from flowing from the outside to the inside of the hollow 911.

BRIEF SUMMARY OF THE DISCLOSURE

FIG. 12A illustrates the pressure change at each point in a blower chamber from the center axis of the hollow 911 toward the outer periphery of the hollow 911. FIG. 12B illustrates the displacement of each point of the bottom plate 918 that forms a part from the center axis of the hollow 911 to the outer periphery of the hollow 911.

When the pump 900 of Patent Document 1 is operated at a resonant frequency of a third-order mode, the piezoelectric disk 920 bends and vibrates the disc 912. In response to the bending vibration of the disc 912, the bottom plate 918 also bends and vibrates, as illustrated in FIG. 12B. Thus, gas flows from the inlet 915 into the hollow 911, and gas in the hollow 911 is discharged from the outlet 914.

As a result, as illustrated in FIG. 12A, the pressure at each point in the hollow 911 is changed by the bending vibrations of the disc 912 and the bottom plate 918 from the center axis of the hollow 911 toward the outer periphery of the hollow 911.

However, the present inventor found the following problems by superimposing the displacement of each point of the bottom plate 918 shown in FIG. 12B on the pressure change at each point in the blower chamber shown in FIG. 12A in the pump 900 of Patent Document 1 (see FIG. 13).

First, when the pressure of air becomes a positive pressure higher than an atmospheric pressure P1 in a first outer peripheral space Q1 of the hollow 911, as illustrated in FIG. 13, an outer peripheral region of the bottom plate 918 is located apart from an initial position P2 of the bottom plate 918 on a side opposite from the disc 912. That is, when the pressure of air becomes a positive pressure in the first outer peripheral space Q1 of the hollow 911, the outer peripheral region of the bottom plate 918 attempts to decrease the pressure in the hollow 911.

Next, when the pressure of air becomes a negative pressure lower than the atmospheric pressure P1 in a second outer peripheral space Q2 of the hollow 911, as illustrated in FIG. 13, the outer peripheral region of the bottom plate 918 is closer to the disc 912 than the initial position P2 of the bottom plate 918. That is, when the pressure of air becomes a negative pressure in the second outer peripheral space Q2 of the hollow 911, the outer peripheral region of the bottom plate 918 attempts to increase the pressure in the hollow 911.

Therefore, in Patent Document 1, when the pump 900 operates at the resonant frequency of the third-order mode, the pressure resonance of air in the hollow 911 (blower chamber) is reduced by the bending vibration of the outer peripheral region of the bottom plate 918 (vibrating body), and this reduces the discharge pressure and the discharge flow rate.

An object of the present disclosure is to provide a blower that can prevent the discharge pressure and the discharge flow rate from being reduced by the bending vibration of an outer peripheral region of a vibrating body.

To achieve the above object, a blower according to the present disclosure is configured as follows.

The present disclosure provides a blower including:

an actuator including a vibrating body having a first principal surface and a second principal surface and a driving body provided on at least one of the first principal surface and the second principal surface of the vibrating body to bend and vibrate the vibrating body in a vibration mode of a third or more odd order that forms a plurality of vibration nodes;

a housing joined to the vibrating body to form a blower chamber with the actuator and having a vent that allows an inside and an outside of the blower chamber to communicate with each other; and a restraining plate, wherein the vibrating body includes an outer peripheral region in contact with an area from an outermost pressure vibration node in the blower chamber, among the pressure vibration nodes formed by the bending vibration of the vibrating body, to an outer periphery of the blower chamber, and a center region located in an inner side portion of the outer peripheral region, and wherein the restraining plate restrains the outer peripheral region.

In this structure, the pressure at each point in the blower chamber from the center axis of the blower chamber toward the outer periphery of the blower chamber is changed by the bending vibration of the vibrating body. The blower chamber includes an outer peripheral space in contact with the outer peripheral region of the vibrating body and a center space provided in an inner side portion of the outer peripheral space to be in contact with the center region of the vibrating body.

The blower having this structure operates at a resonant frequency of an odd order vibration mode. While the blower having this structure is operating, when the pressure of gas (for example, air) falls below a reference pressure (for example, atmospheric pressure) in the outer peripheral space of the blower chamber, the bending vibration of the outer peripheral region is suppressed and reduced. When the pressure of gas exceeds the reference pressure in the outer peripheral space of the blower chamber, the bending vibration of the outer peripheral region is suppressed and reduced.

That is, in this structure, the outer peripheral region of the vibration body does not adversely affect the pressure in the blower chamber and does not reduce the pressure resonance of gas in the blower chamber.

Therefore, the blower of the present disclosure can prevent the discharge pressure and the discharge flow rate from being reduced by the bending vibration of the outer peripheral region of the vibrating body. For this reason, the blower of the present disclosure can achieve a high discharge pressure and a high discharge flow rate.

A rigidity of the outer peripheral region is preferably higher than a rigidity of the center region.

With this structure, the restraining member can restrain the bending vibration of the outer peripheral region.

A thickness of the outer peripheral region is preferably larger than a thickness of the center region.

This structure makes the rigidity of the outer peripheral region higher than the rigidity of the center region.

A shortest distance a from a center axis of the blower chamber to an end of an area in an inner side portion of a joint portion of the vibrating body to the housing and a vibration frequency f of the actuator preferably satisfy a relation that $af=(k_0c)/(2\pi)$ wherein c represents an acoustic velocity of gas passing through the blower chamber and $k_0$ represents a value to satisfy a relation that a Bessel function of a first kind $J_0'(k_0)$ is equal to 0.

In this structure, the vibrating body and the housing are provided to obtain the shortest distance a. The driving body vibrates the actuator at the vibration frequency f.

The value $k_0$ satisfies the relation that $J_0'(k_0)=0$ when $J_0'(k_0)$ is a differential value of the Bessel function of the first kind. Further, the value a represents the shortest distance from the center axis of the blower chamber to the end of the area in the inner side portion of the joint portion of the vibrating body to the housing.

Here, when $af=(k_0c)/(2\pi)$, the outermost node among the vibration nodes of the vibrating body coincides with a pressure vibration node in the blower chamber, and this produces the pressure resonance.

For this reason, when the relation that $af=(k_0c)/(2\pi)$ is satisfied, the blower having this structure can achieve a high discharge pressure and a high flow rate.

The driving body is preferably a piezoelectric body.

The blower having this structure can achieve noise reduction by using, as a driving source, the piezoelectric body that generates little sound and vibration during driving.

A valve is preferably provided at the vent to prevent gas from flowing from the outside to the inside of the blower chamber.

In the blower having this structure, the valve can prevent gas from flowing from the outside of the blower chamber to the inside of the blower chamber through the vent. For this reason, the blower having this structure can achieve a high discharge pressure and a high flow rate.

According to the present disclosure, it is possible to prevent the discharge pressure and the discharge flow rate from being reduced by the bending vibration of the outer peripheral region of the vibrating body.

DETAILED DESCRIPTION OF THE DISCLOSURE

Embodiment of Disclosure

A piezoelectric blower 100 according to an embodiment of the present disclosure will be described below.

Figure 1:
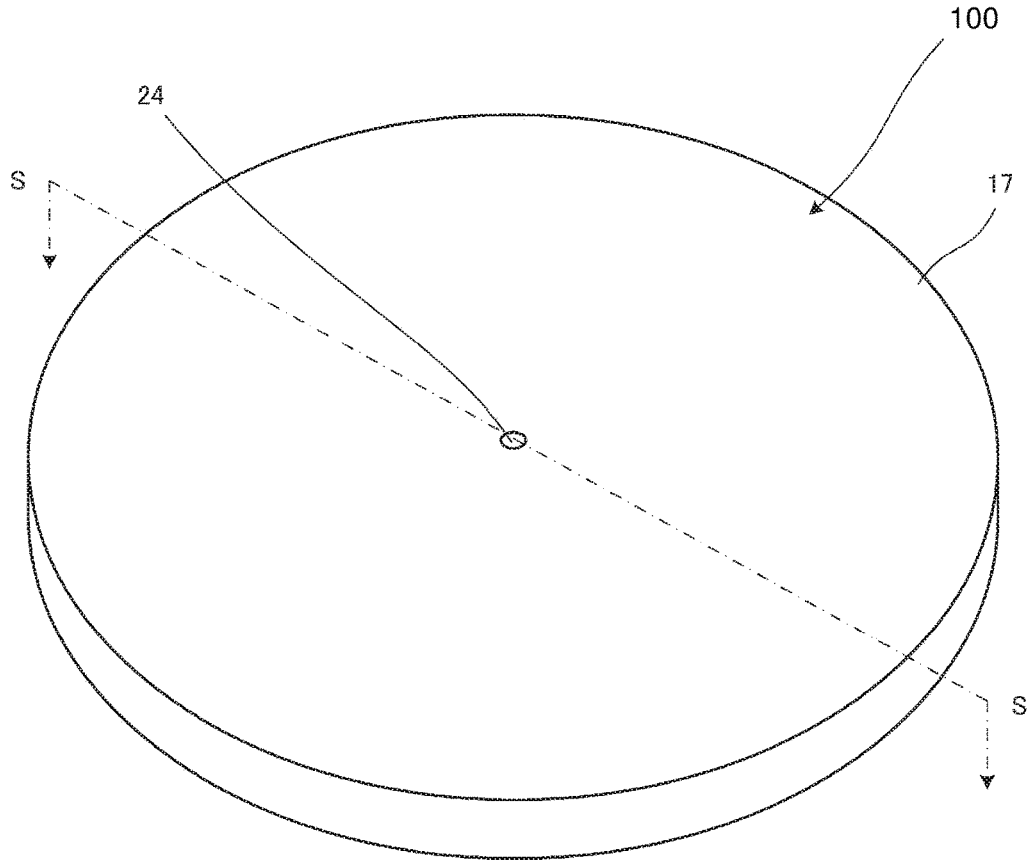
FIG. 1 is an external perspective view of a piezoelectric blower 100 according to an embodiment of the present disclosure.
Figure 2:
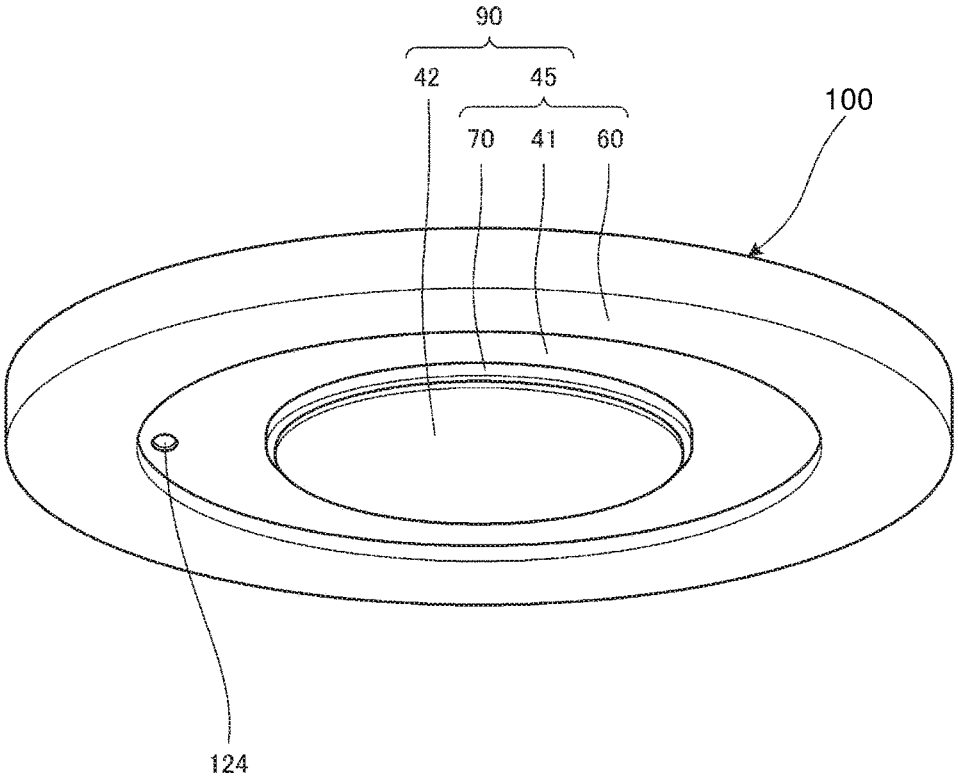
FIG. 2 is an external perspective view of the piezoelectric blower 100 illustrated in FIG. 1.
Figure 3:
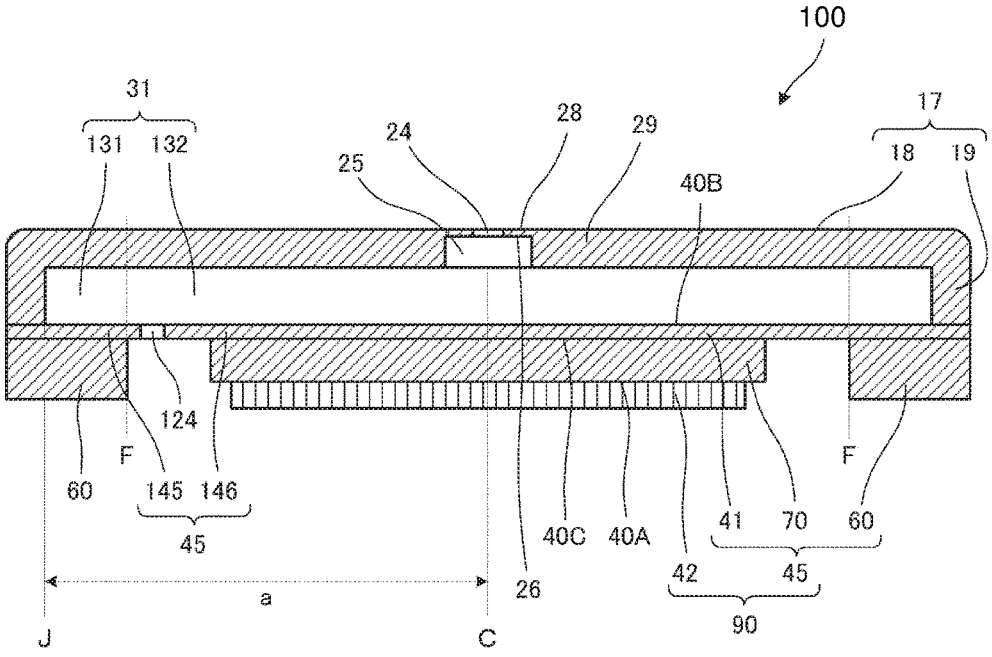
FIG. 3 is a cross-sectional view of the piezoelectric blower 100, taken along line S-S of FIG. 1.

FIG. 1 is an external perspective view of the piezoelectric blower 100 according to the embodiment of the present disclosure. FIG. 2 is an external perspective view of the piezoelectric blower 100 illustrated in FIG. 1. FIG. 3 is a cross-sectional view of the piezoelectric blower 100, taken along line S-S of FIG. 1.

The piezoelectric blower 100 includes a housing 17, a vibrating body 45, and a piezoelectric element 42 in order from above, and has a structure in which these components are stacked in order. The vibrating body 45 includes a vibration plate 41, a reinforcing plate 70, and a restraining plate 60, and has a structure in which these plates are stacked. The vibrating body 45 has a first principal surface 40A and a second principal surface 40B.

The vibration plate 41 is disc-shaped, and is formed of, for example, stainless steel (SUS). In the embodiment, the thickness of the vibration plate 41 is 0.1 mm.

The second principal surface 40B of the vibrating body 45 is joined to a distal end of the housing 17. Thus, the vibrating body 45 forms a columnar blower chamber 31 with the housing 17 while holding the blower chamber 31 therebetween from the thickness direction of the vibration plate 41. The vibrating body 45 and the housing 17 are provided so that the blower chamber 31 has a radius a. In the embodiment, the radius a of the blower chamber 31 is 10.3 mm.

For this reason, an area in an inner side portion of a part of the second principal surface 40B of the vibrating body 45 joined to the housing 17 forms a bottom surface of the blower chamber 31. The vibrating body 45 has a columnar vent 124 that allows the blower chamber 31 to communicate with the outside of the blower chamber 31. The diameter of the vent 124 is 0.8 mm.

The vibrating body 45 has an outer peripheral region 145 in contact with an area from the outermost node F, among pressure vibration nodes of the blower chamber 31 formed by the bending vibration of the vibrating body 45, to the outer periphery of the blower chamber 31, and a center region 146 located in an inner side portion of the outer peripheral region 145. The restraining plate 60 restrains the bending vibration of the outer peripheral region 145.

Details of the pressure vibration nodes in the blower chamber 31 will be described later.

The restraining plate 60 for restraining the bending vibration of the outer peripheral region 145 is joined to a principal surface 40C of the vibration plate 41. Thus, the thickness of the outer peripheral region 145 is larger than the thickness of the center region 146. For this reason, the rigidity of the outer peripheral region 145 is higher than the rigidity of the center region 146. The restraining plate 60 has an annular shape, and is formed of, for example, stainless steel. The inner diameter of the restraining plate 60 is 17 mm.

The blower chamber 31 includes an outer peripheral space 131 in contact with the outer peripheral region 145 of the vibrating body 45, and a center space 132 located in an inner side portion of the outer peripheral space 131 to be in contact with the center region 146 of the vibrating body 45.

The reinforcing plate 70 is disc-shaped, and is formed of, for example, stainless steel. The reinforcing plate 70 is joined to the principal surface 40C of the vibration plate 41 opposite from the blower chamber 31. The reinforcing plate 70 prevents the piezoelectric element 42 from being broken by bending the piezoelectric element 42.

The piezoelectric element 42 is disc-shaped, and is formed of, for example, a PZT-based ceramic material. Electrodes are provided on both principal surfaces of the piezoelectric element 42.

The piezoelectric element 42 is joined to the first principal surface 40A of the reinforcing plate 70 opposite to the blower chamber 31. The piezoelectric element 42 expands and contracts in accordance with the applied alternating-current voltage. In the embodiment, the diameter of the piezoelectric element 42 is 11 mm, and the thickness of the piezoelectric element 42 is 0.15 mm.

A joint body of the piezoelectric element 42, the reinforcing plate 70, the restraining plate 60, and the vibration plate 41 forms a piezoelectric actuator 90.

The housing 17 has an angular U-shaped cross section opening downward. The distal end of the housing 17 is joined to the vibration plate 41. For example, the housing 17 is formed of metal.

The housing 17 includes a disc-shaped top plate portion 18 opposed to the second principal surface 40B of the vibration plate 41, and an annular side wall portion 19 connected to the top plate portion 18. A part of the top plate portion 18 forms a top surface of the blower chamber 31.

The top plate portion 18 has a columnar vent 24 that allows the blower chamber 31 to communicate with the outside of the blower chamber 31. The diameter of the vent 24 is 1.4 mm.

The top plate portion 18 includes a thick top portion 29 and a thin top portion 28 located on an inner peripheral side of the thick top portion 29. The top plate portion 18 has, in the thin top portion 28, a vent 24 that allows the inside and the outside of the blower chamber 31 to communicate with each other.

On a side of the top plate portion 18 close to the vibration plate 41, a recess 26 is provided as a part of the blower chamber 31 to form a cavity 25 communicating with the vent 24. The cavity 25 has a columnar shape. The diameter of the cavity 25 is 3.0 mm, and the thickness of the cavity 25 is 0.3 mm.

Hereinafter, a description will be given of the flow of air during the operation of the piezoelectric blower 100.

Figure 4A:
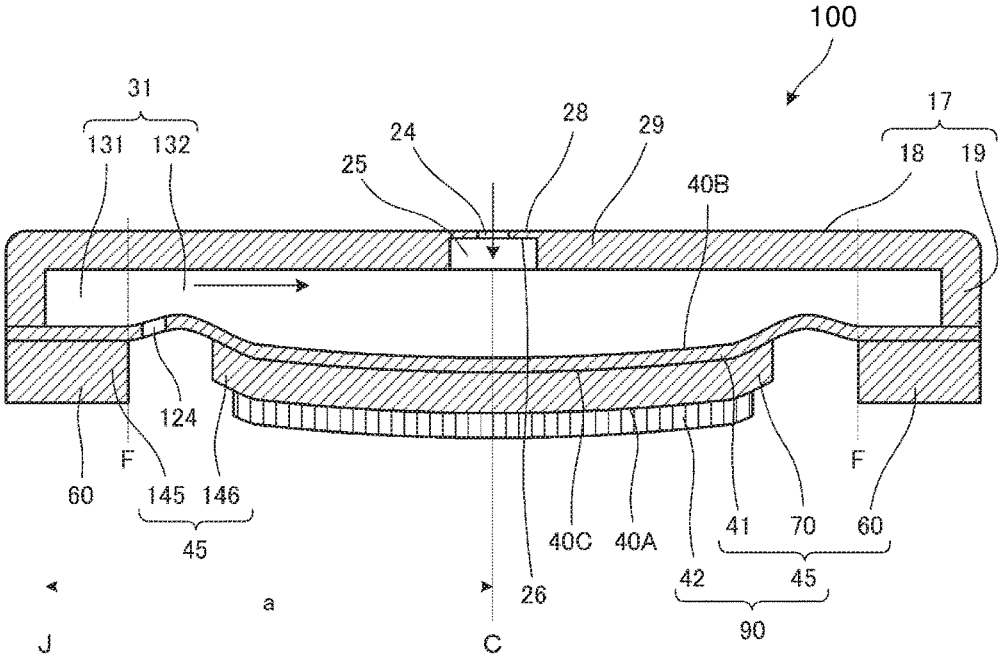
FIGS. 4A and 4B include cross-sectional views of the piezoelectric blower 100, taken along line S-S of FIG. 1, when the piezoelectric blower 100 is operated at a resonant frequency (fundamental wave) of a third-order mode.
Figure 4B:
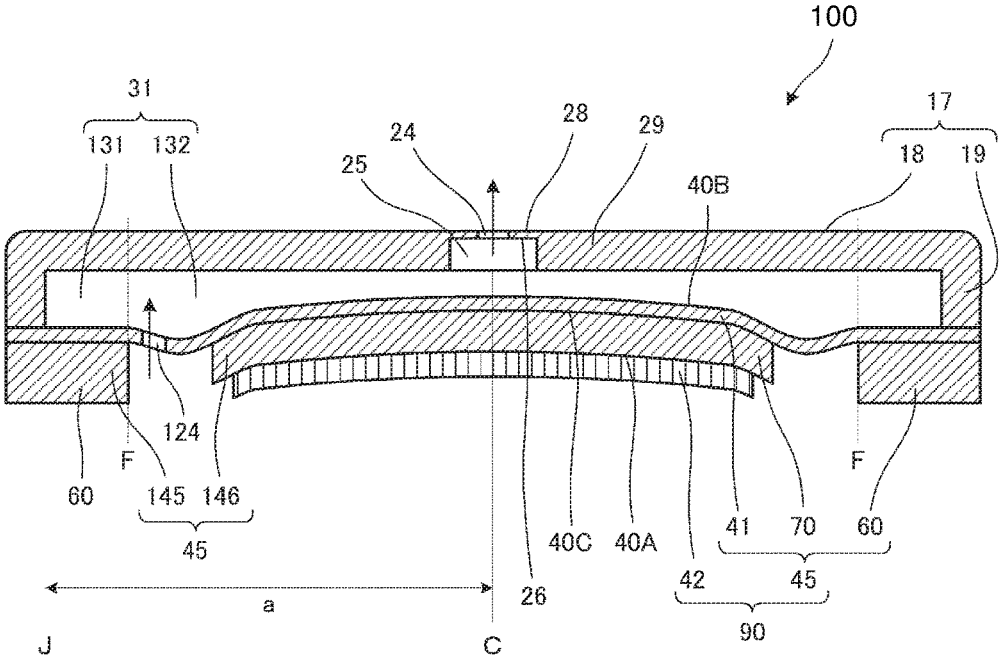

FIGS. 4A and 4B are cross-sectional views of the piezoelectric blower 100, taken along line S-S of FIG. 1, when the piezoelectric blower 100 is operated at a resonant frequency (fundamental wave) of a third-order mode. FIG. 4A illustrates a state in which the capacity of the blower chamber 31 is maximally increased, and FIG. 4B illustrates a state in which the capacity of the blower chamber 31 is maximally decreased. Here, the arrows in the figures show flows of air.

Figure 5:
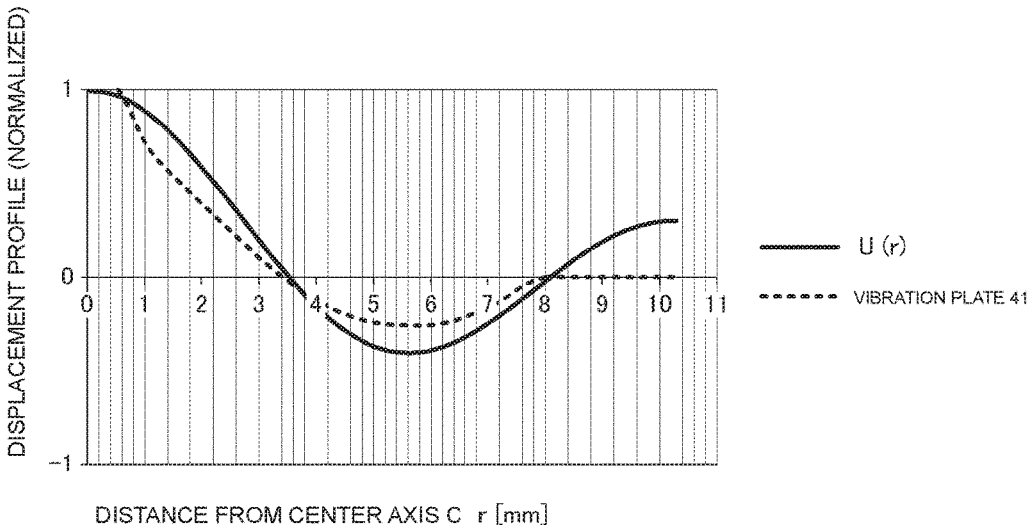
FIG. 5 shows the relationship between the pressure change at each point in a blower chamber 31 from a center axis C of the blower chamber 31 toward an outer periphery of the blower chamber 31 and the displacement of each point of a vibration plate 41 that forms a part from the center axis C of the blower chamber 31 to the outer periphery of the blower chamber 31 at the instant illustrated in FIG. 4B.

FIG. 5 shows the relationship between the pressure change at each point in the blower chamber 31 from the center axis C of the blower chamber 31 toward the outer periphery of the blower chamber 31 and the displacement of each point of the vibration plate 41 that forms the part from the center axis C of the blower chamber 31 toward the outer periphery of the blower chamber 31 at the instant illustrated in FIG. 4B.

Here, in FIG. 5, the pressure change at each point in the blower chamber 31 and the displacement of each point of the vibration plate 41 are represented by values normalized by the displacement of the center of the vibration plate 41 on the center axis C of the blower chamber 31. A pressure change distribution u(r) at the points in the blower chamber 31 shown in FIG. 5 is given by the expression $u(r)=J_0(k_0r/a)$ wherein r represents the distance from the center axis C of the blower chamber 31.

In the state illustrated in FIG. 3, when an alternating-current driving voltage of 30 Vpp at a resonant frequency f (40.89 kHz) of the third-order mode is applied to the electrodes on both principal surfaces of the piezoelectric element 42, the piezoelectric element 42 expands and contracts, and concentrically bends and vibrates the vibrating body 45 at the resonant frequency f of the third-order mode.

Thus, as illustrated in FIGS. 4A and 4B, the vibrating body 45 bends and deforms, and the volume of the blower chamber 31 changes periodically.

As illustrated in FIG. 4A, when the vibrating body 45 bends toward the piezoelectric element 42, the capacity of the blower chamber 31 increases. Along with this, air outside the piezoelectric blower 100 is sucked into the blower chamber 31 through the vent 24.

As illustrated in FIG. 4B, when the vibrating body 45 bends toward the blower chamber 31, the capacity of the blower chamber 31 decreases. Along with this, air outside the piezoelectric blower 100 is sucked into the blower chamber 31 through the vent 124 and air in the blower chamber 31 is discharged from the vent 24.

The radius a of the blower chamber 31 and the resonant frequency f of the piezoelectric actuator 90 satisfy the relation of $af=(k_0c)/(2\pi)$ wherein c represents the acoustic velocity of air passing through the blower chamber 31 and $k_0$ represents the value satisfying the relation that $J_0'(k_0)=0$ wherein $J_0'(k_0)$ is a differential value of the Bessel function of the first kind. The Bessel function $J_0(x)$ of the first kind is given by the following equation.

$$J_0(x) = \sum_{m=0}^{\infty} \frac{(-1)^m}{m!\Gamma(m+1)}\left(\frac{x}{2}\right)^{2m} \quad \text{[Math. 1]}$$

In the embodiment, the radius a of the blower chamber 31 is the shortest distance from the center axis C of the blower chamber 31 to an end J of an inner side area of the joint portion of the vibration plate 41 to the housing 17. The resonant frequency f is 40.89 kHz. The acoustic velocity c of air is about 340 m/s. The value $k_0$ is 7.02.

As shown by a dotted line in FIG. 5, the points of the vibration plate 41 that form the part from the center axis C of the blower chamber 31 to the outer periphery of the blower chamber 31 are displaced by the bending vibration. As shown by a solid line in FIG. 5, the pressures at the points in the blower chamber 31 are changed by the bending vibration of the vibration plate 41 from the center axis C of the blower chamber 31 to the outer periphery of the blower chamber 31.

In the piezoelectric blower 100, the radius a of the blower chamber 31 and the resonant frequency f of the actuator 90 satisfy the relation that $af=(k_0c)/(2\pi)$. For this reason, in the piezoelectric blower 100, the outermost node F among the vibration nodes of the vibration plate 41 coincides with the pressure vibration node in the blower chamber 31, and this produces pressure resonance.

Here, while the piezoelectric blower 100 is operating, when the pressure of air exceeds the atmospheric pressure in the outer peripheral space 131 of the blower chamber 31, since the restraining plate 60 is provided in the outer peripheral region 145 of the vibrating body 45 (an area from the distance of about 8 mm to the end J), the bending vibration of the outer peripheral region 145 is suppressed and reduced, as shown in FIG. 5. When the pressure of air falls below the atmospheric pressure in the outer peripheral space 131 of the blower chamber 31, similarly, the outer peripheral region 145 of the vibrating body 45 is restrained by the restraining plate 60, and this suppresses and reduces the bending vibration of the outer peripheral region 145.

That is, in this structure, the outer peripheral region 145 of the vibrating body 45 does not adversely affect the pressure in the blower chamber 31, and does not reduce pressure resonance of air in the blower chamber 31.

Therefore, in the piezoelectric blower 100, the discharge pressure and the discharge flow rate can be prevented from being decreased by the bending vibration of the outer peripheral region 145 of the vibrating body 45. For this reason, the piezoelectric blower 100 can achieve a high discharge pressure and a high discharge flow rate.

In the piezoelectric blower 100, when the vibration plate 41 vibrates, the distribution of displacements of the points of the vibration plate 41 in the inner side portion of the vibration node F of the vibration plate 41 approximates to the distribution of pressure changes at the points in the blower chamber 31 in the inner side portion of the pressure vibration node F of the blower chamber 31, as shown in FIG. 5.

For this reason, in the piezoelectric blower 100, vibration energy of the vibration plate 41 can be transmitted to air in the blower chamber 31 while being hardly lost. Therefore, the piezoelectric blower 100 can achieve a high discharge pressure and a high discharge flow rate.

The piezoelectric blower 100 includes the cavity 25 near the vent 24 of the blower chamber 31. For this reason, in the piezoelectric blower 100, an eddy generated near the vent 24 of the blower chamber 31 weakens in the cavity 25. This can prevent the pressure vibration of the blower chamber 31 from being disturbed by the eddy.

Hence, in the piezoelectric blower 100, it is possible to weaken the eddy generated near the vent 24 of the blower chamber 31 and to prevent reduction in the discharge pressure.

Since the piezoelectric blower 100 uses, as a driving source, the piezoelectric body that causes little sound and vibration during driving, noise reduction can be achieved.

Hereinafter, the piezoelectric blower 100 according to the embodiment of the present disclosure will be compared with a piezoelectric blower 150 according to a comparative example of the embodiment of the disclosure. First, the structure and operation of the piezoelectric blower 150 will be described.

Figure 6:
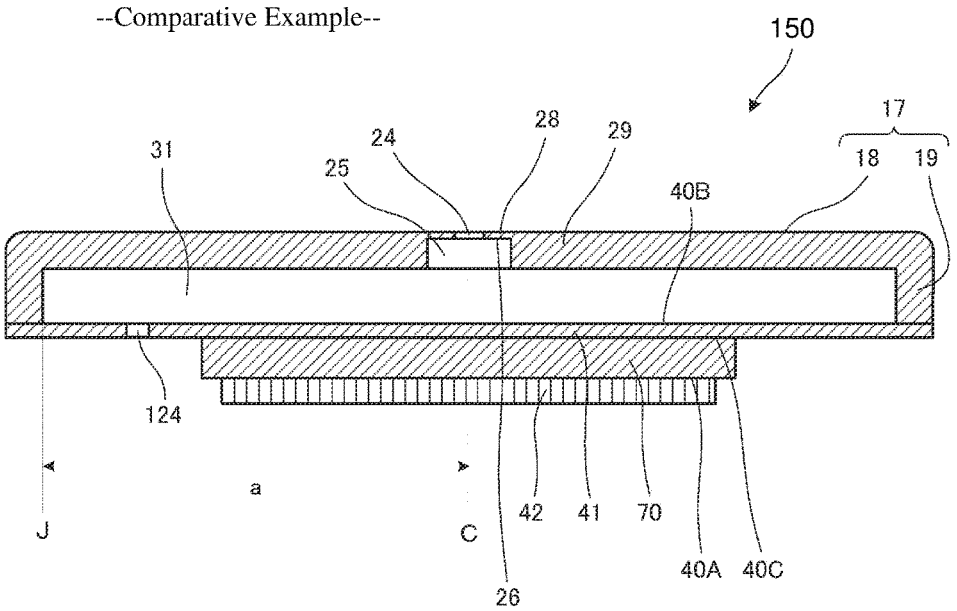
FIG. 6 is a cross-sectional view of a piezoelectric blower 150 according to a comparative example of the embodiment of the present disclosure.

FIG. 6 is a cross-sectional view of the piezoelectric blower 150 according to the comparative example of the embodiment of the present disclosure. The piezoelectric blower 150 is different from the piezoelectric blower 100 in that it does not include the restraining plate 60. Since other points are the same, the descriptions thereof are skipped.

In a state illustrated in FIG. 6, when an alternating-current driving voltage of 30 Vpp at a driving frequency f (40.89 kHz) of a third-order mode is applied to electrodes on both principal surfaces of a piezoelectric element 42, the piezoelectric element 42 expands and contracts, and concentrically bends and vibrates a vibration plate 41 and a reinforcing plate 70 at the driving frequency f of the third-order mode.

Thus, similarly to the piezoelectric blower 100 illustrated in FIGS. 4A and 4B, the vibration plate 41 and the reinforcing plate 70 in the piezoelectric blower 150 also bend and deform, and the volume of a blower chamber 31 changes periodically.

Figure 7:
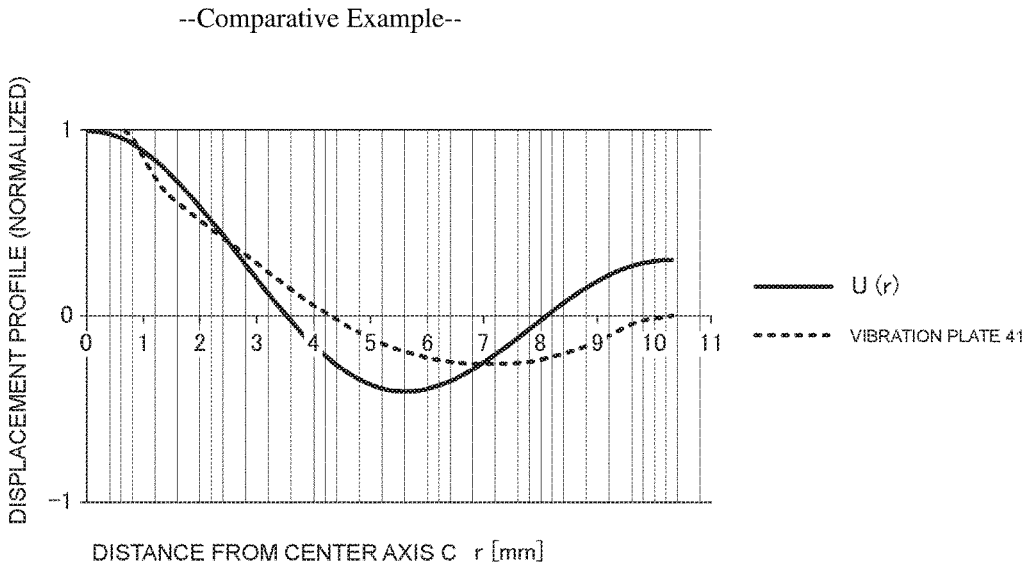
FIG. 7 shows the relationship between the pressure change at each point in a blower chamber 31 and the displacement of each point of a vibration plate 41 in the piezoelectric blower 150 illustrated in FIG. 6.

FIG. 7 shows the relationship between the pressure change at each point in the blower chamber 31 and the displacement of each point of the vibration plate 41 in the piezoelectric blower 150 of FIG. 6. In FIG. 7, similarly to FIG. 5, the pressure change at each point in the blower chamber 31 and the displacement of each point of the vibration plate 41 are represented by values normalized by the displacement of the center of the vibration plate 41 on the center axis C of the blower chamber 31. Similarly to FIG. 5, a distribution u(r) of the pressure changes at the points in the blower chamber 31 illustrated in FIG. 7 is given by an equation $u(r)=J_0(k_0r/a)$ wherein r represents the distance from the center axis C of the blower chamber 31.

As shown by a dotted line in FIG. 7, the points of the vibration plate 41 that form a part from the center axis C of the blower chamber 31 to an outer periphery of the blower chamber 31 are displaced by the bending vibration. As shown by a solid line in FIG. 7, the pressures at the points in the blower chamber 31 are changed by the bending vibration of the vibration plate 41 from the center axis C of the blower chamber 31 to the outer periphery of the blower chamber 31.

Here, the waveform shown by the dotted line in FIG. 7 and the waveform shown by the solid line in FIG. 7 are displaced in opposite directions in an outer peripheral region (an area from the distance of about 8 mm to an end J). For this reason, in the piezoelectric blower 150, the outer peripheral region of the vibration plate 41 adversely affects the pressure in the blower chamber 31, similarly to the pump 900 of Patent Document 1.

Next, the following shows the measurement results of the force (mN) of air flowing out from a vent 24 of the piezoelectric blower 150 and the force (mN) of air flowing out from the vent 24 of the piezoelectric blower 100 under a condition that a sine-wave alternating-current voltage of 30 Vpp at a driving frequency f (40.89 kHz) was applied to the piezoelectric blower 150 and the piezoelectric blower 100.

It was experimentally revealed that the force of air in the piezoelectric blower 150 was 1009.4 (mN), whereas the force of air in the piezoelectric blower 100 was 1724.8 (mN).

It is considered that the above results were obtained because the bending vibration of the outer peripheral region 145 of the vibrating body 45 was restrained by the restraining plate 60 in the piezoelectric blower 100 and the outer peripheral region 145 of the vibrating body 45 did not adversely affect the pressure in the blower chamber 31.

Therefore, in the piezoelectric blower 100, the discharge pressure and the discharge flow rate can be prevented from being reduced by the bending vibration of the outer peripheral region 145 of the vibrating body 45. For this reason, the piezoelectric blower 100 can achieve a high discharge pressure and a high discharge flow rate.

Other Embodiment

While air is used as fluid in the embodiment, the fluid is not limited thereto. The present disclosure can be applied to a case in which the fluid is a gas different from air.

Figure 8:
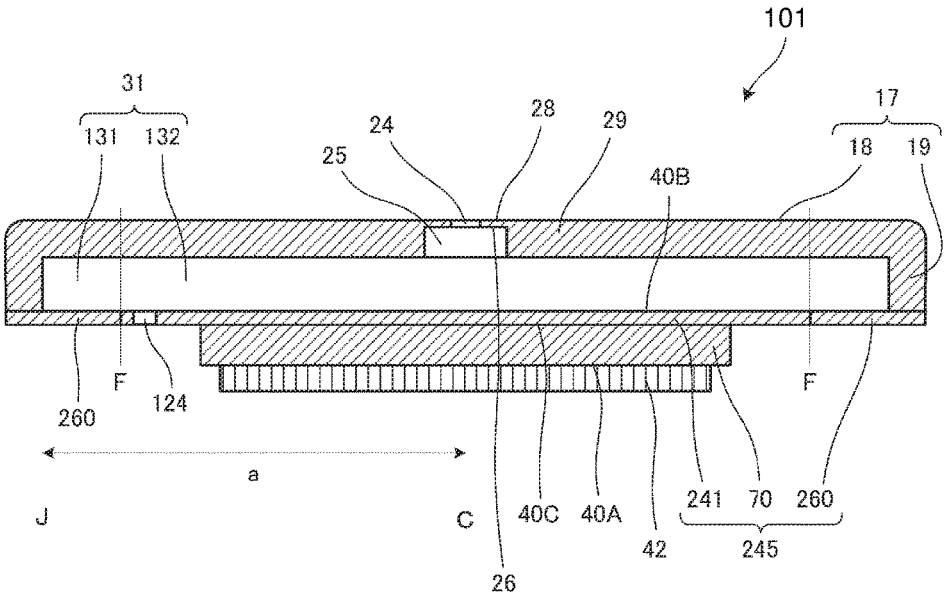
FIG. 8 is a cross-sectional view of a piezoelectric blower 101 according to a first modification of the embodiment of the present disclosure.

While the piezoelectric blower 100 includes the restraining plate 60 in the above embodiment, the structure is not limited thereto. For example, as illustrated in FIG. 8, a piezoelectric blower 101 may include a vibrating body 245 having a center region 241 and an outer peripheral region 260 formed of a material having a rigidity higher than that of the center region 241 without including the restraining plate 60.

Figure 9:
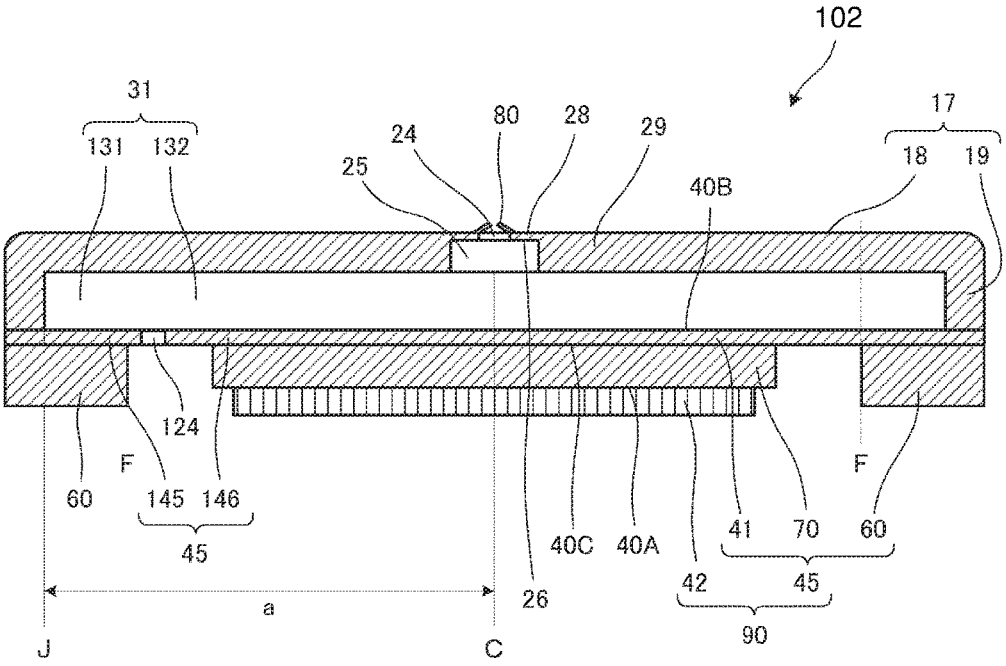
FIG. 9 is a cross-sectional view of a piezoelectric blower 102 according to a second modification of the embodiment of the present disclosure.

While the vent 24 is provided in the above embodiment, the following modification can be adopted. That is, as in a piezoelectric blower 102 illustrated in FIG. 9, a thin top portion 28 (specifically, around a vent 24 in the thin top portion 28) may be provided with a valve 80 that prevents gas from flowing into a blower chamber 31 from the outside through the vent 24 (see the arrow in FIG. 4A). This can cause air to flow in one direction during driving the piezoelectric blower 102.

Figure 10:
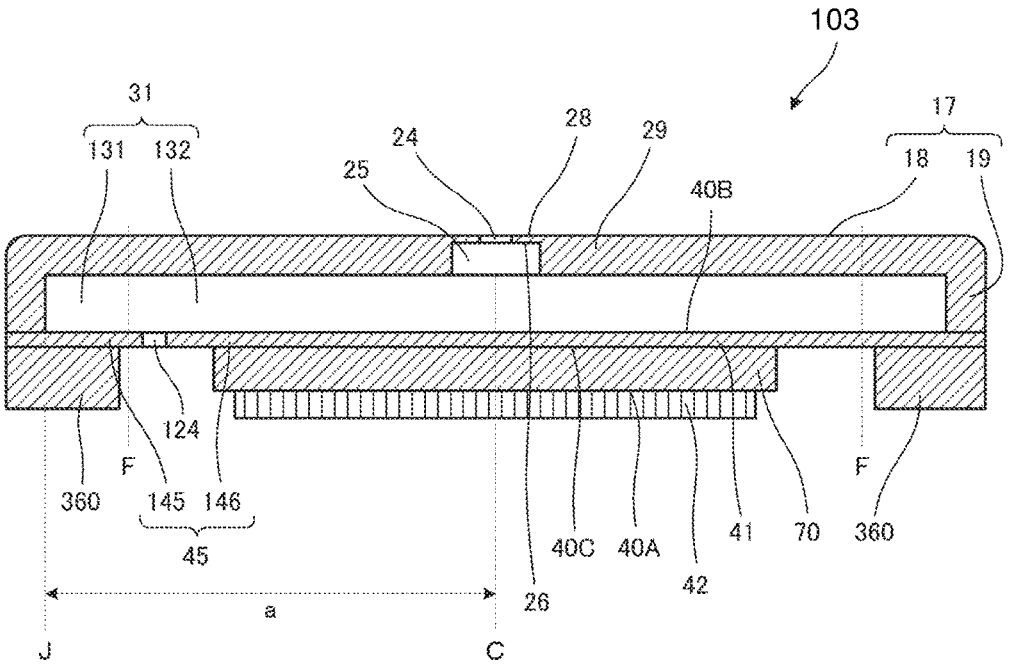
FIG. 10 is a cross-sectional view of a piezoelectric blower 103 according to a third modification of the embodiment of the present disclosure.
Figure 11:
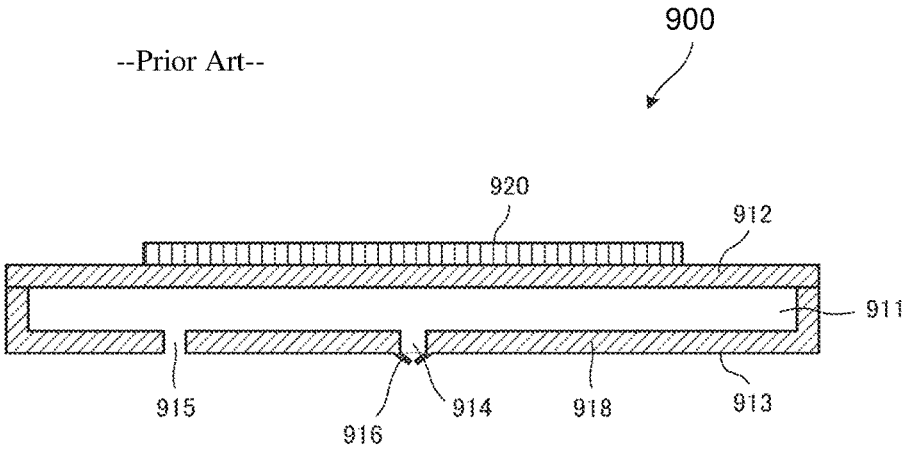
FIG. 11 is a cross-sectional view of a pump 900 according to Patent Document 1.
Figure 12A:
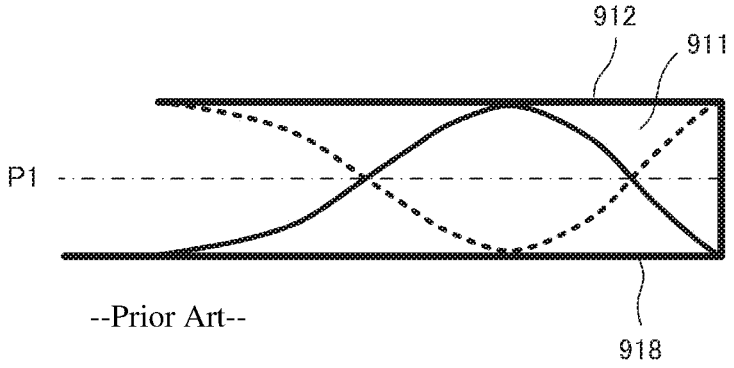
FIG. 12A shows the pressure change at each point in a hollow 911 from a center axis of the hollow 911 toward an outer periphery of the hollow 911.
Figure 12B:
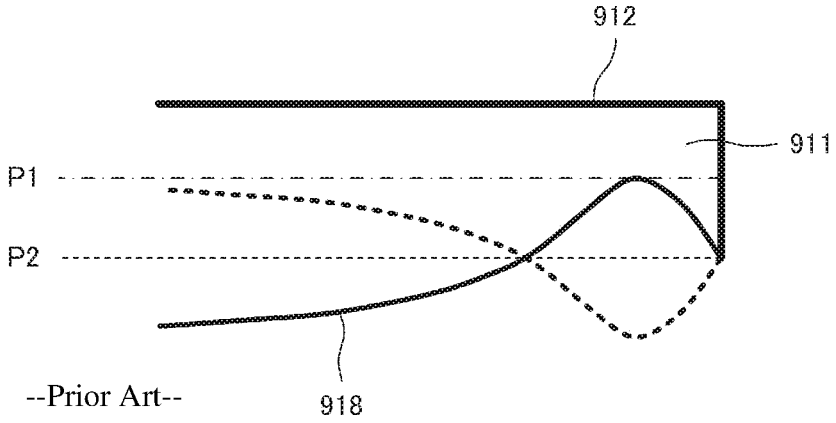
FIG. 12B shows the displacement of each point of a bottom plate 918 that forms a part from the center axis of the hollow 911 to the outer periphery of the hollow 911.
Figure 13:
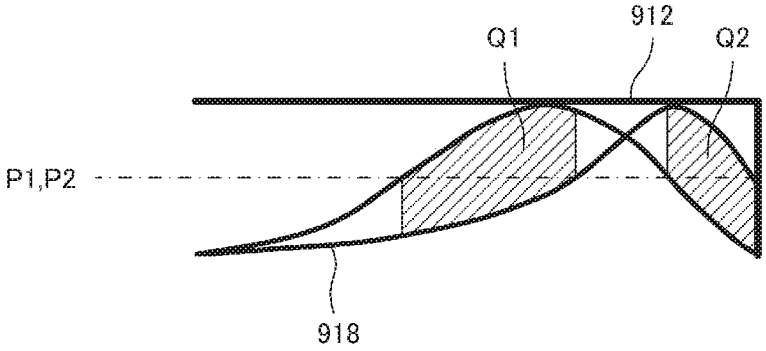
FIG. 13 illustrates the displacement of each point of the bottom plate 918 illustrated in FIG. 12B superimposed on the pressure change at each point in the blower chamber 31 illustrated in FIG. 12A.

While the restraining plate 60 is provided all over the outer peripheral region 145 in the above embodiment as illustrated in FIG. 3, the structure is not limited thereto. As illustrated in FIG. 10, a restraining plate 360 may be provided within an outer peripheral region 145.

While the piezoelectric blower 100 includes the annular restraining plate 60 in the above embodiment, the structure is not limited thereto. The shape of the restraining plate is not particularly limited as long as it is point-symmetrical with respect to the point on the center axis C. The restraining plate may have an annular shape that is partly cut out.

While the vibration plate 41, the reinforcing plate 70, and the restraining plate 60 are formed of SUS in the above embodiment, the material is not limited thereto. These plates may be formed of other materials such as aluminum, titanium, magnesium, and copper.

While the piezoelectric element 42 is provided as the driving source for the blower in the above embodiment, the structure is not limited thereto. For example, the blower may be electromagnetically driven to perform the pumping operation.

While the piezoelectric element 42 is formed of the PZT-based ceramic material in the above embodiment, the material is not limited thereto. For example, the piezoelectric element 42 may be formed of a lead-free piezoelectric ceramic piezoelectric material such as a potassium-sodium niobate based or alkali niobate based ceramic material.

While the piezoelectric element 42 is joined to the first principal surface 40A of the reinforcing plate 70 opposite to the blower chamber 31 in the above embodiment, the structure is not limited thereto. In a practical case, for example, the piezoelectric element 42 may be joined to the second principal surface 40B of the vibration plate 41, or one piezoelectric element 42 may be joined to each of the first principal surface 40A of the reinforcing plate 70 and the second principal surface 40B of the vibration plate 41.

In this case, the housing 17 forms a blower chamber with a piezoelectric actuator composed of at least one piezoelectric element 42, the reinforcing plate 70, and vibration plate 41 while holding the blower chamber therebetween from the thickness direction of the vibration plate 41.

While the disc-shaped piezoelectric element 42, the disc-shaped vibration plate 41, the disc-shaped reinforcing plate 70, the annular restraining plate 60, the disc-shaped top plate portion 18, and so on are used in the above embodiment, the structure is not limited thereto. For example, the shapes of these components may be rectangular or polygonal.

While the condition that $k_0$ is 7.02 is used in the above embodiment, the condition is not limited thereto. The value $k_0$ may be, for example, 2.40, 3.83, 5.52, 8.65, 10.17, 11.79, 13.32, or 14.93 as long as it satisfies the relation that $J_0'(k_0)=0$.

While the vibrating body of the piezoelectric blower is bent and vibrated at the frequency of the third-order mode in the above embodiment, the mode is not limited thereto. In a practical case, the vibration plate may be bent and vibrated in a vibration mode of a third or more odd order.

While the blower chamber 31 has a columnar shape in the above embodiment, the shape is not limited thereto. In a practical case, the blower chamber may be shaped like a regular prism. In this case, the shortest distance a from the center axis of the vibration plate to the outer periphery of the blower chamber is used instead of the radius a of the blower chamber.

Finally, it should be considered that the above description of the embodiments is illustrative in all respects, but is not restrictive. The scope of the present disclosure is shown not by the above embodiments but by the claims. Further, the scope of the present disclosure is intended to include all modifications within the meaning and scope equivalent to the claims.

a radius
C center axis
F node
Q1 first outer peripheral space
Q2 second outer peripheral space
17 housing
18 top plate portion
19 side wall portion
24 vent
25 cavity

26 recess
28 thin top portion
29 thick top portion
31 blower chamber
40A first principal surface
40B second principal surface
40C principal surface
41 vibration plate
42 piezoelectric element
45 vibrating body
60 restraining plate
70 reinforcing plate
80 valve
90 piezoelectric actuator
100 piezoelectric blower
101 piezoelectric blower
102 piezoelectric blower
124 vent
131 outer peripheral space
132 center space
145 outer peripheral region
146 center region
150 piezoelectric blower
241 center region
245 vibrating body
260 outer peripheral region
360 restraining plate
900 pump
911 hollow
912 disk
913 main body
914 outlet
915 inlet
916 valve
918 bottom plate
920 piezoelectric disk

The invention claimed is:

1. A blower comprising:

an actuator including a vibrating body having a first principal surface and a second principal surface and a driving body provided on at least one of the first principal surface and the second principal surface of the vibrating body to bend and vibrate the vibrating body in a vibration mode of a third or more odd order forming a plurality of vibration nodes; and a housing joined to the vibrating body to form a blower chamber with the actuator and having a vent allowing an inside and an outside of the blower chamber to communicate with each other;

wherein the vibrating body includes a vibration plate and a restraining plate, wherein the restraining plate is joined to the vibration plate on a side opposite from the housing, wherein the vibrating body includes an outer peripheral region in contact with an area from an outermost pressure vibration node in the blower chamber, among pressure vibration nodes formed by the bending vibration of the vibrating body, to an outer periphery of the blower chamber, wherein the vibrating body includes a center region located in an inner side portion of the outer peripheral region, and wherein the restraining plate restrains the outer peripheral region of the vibrating body.

2. The blower according to claim 1, wherein a rigidity of the outer peripheral region is higher than a rigidity of the center region.

3. The blower according to claim 2, wherein a thickness of the outer peripheral region is larger than a thickness of the center region.

4. The blower according to claim 2, wherein the driving body is a piezoelectric body.

5. The blower according to claim 2, wherein the vent comprises a valve to prevent gas from flowing from the outside of the blower chamber to the inside of the blower chamber.

6. The blower according to claim 1, wherein a thickness of the outer peripheral region is larger than a thickness of the center region.

7. The blower according to claim 6, wherein the driving body is a piezoelectric body.

8. The blower according to claim 6, wherein the vent comprises a valve to prevent gas from flowing from the outside of the blower chamber to the inside of the blower chamber.

9. The blower according to claim 1, wherein a shortest distance (a) from a center axis of the blower chamber to an end of an area in an inner side portion of a joint portion of the vibrating body to the housing and a vibration frequency (f) of the actuator satisfy a relation that $(a)(f)=(k_0)(c)/(2\pi)$ wherein (c) represents an acoustic velocity of gas passing through the blower chamber and $(k_0)$ represents a value to satisfy a relation that a Bessel function of a first kind $J_0'(k_0)$ is equal to 0.

10. The blower according to claim 9, wherein the driving body is a piezoelectric body.

11. The blower according to claim 9, wherein the vent comprises a valve to prevent gas from flowing from the outside of the blower chamber to the inside of the blower chamber.

12. The blower according to claim 1, wherein the driving body is a piezoelectric body.

13. The blower according to claim 12, wherein the vent comprises a valve to prevent gas from flowing from the outside of the blower chamber to the inside of the blower chamber.

14. The blower according to claim 1, wherein the vent comprises a valve to prevent gas from flowing from the outside of the blower chamber to the inside of the blower chamber.

15. The blower according to claim 1, wherein the restraining plate extends at least from the outermost pressure vibration node to an outer periphery of the housing.

16. A blower comprising:

an actuator including a vibrating body having a first principal surface and a second principal surface and a driving body provided on at least one of the first principal surface and the second principal surface of the vibrating body to bend and vibrate the vibrating body in a vibration mode of a third or more odd order forming a plurality of vibration nodes;

a housing joined to the vibrating body to form a blower chamber with the actuator and having a vent allowing an inside and an outside of the blower chamber to communicate with each other; and a restraining plate, wherein the vibrating body includes an outer peripheral region in contact with an area from an outermost pressure vibration node in the blower chamber, among pressure vibration nodes formed by the bending vibration of the vibrating body, to an outer periphery of the blower chamber, wherein the vibrating body includes a center region located in an inner side portion of the outer peripheral region, wherein the restraining plate restrains the outer peripheral region of the vibrating body, and wherein the restraining plate extends at least from the outermost pressure vibration node to the outer periphery of the blower chamber.

* * * * *